United States Patent [19]

Thebaud

[11] 4,186,959

[45] Feb. 5, 1980

[54] FOLDABLE CHAIR

[76] Inventor: Sacha Thebaud, P.O. Box 446, Port-Au-Prince, Haiti

[21] Appl. No.: 889,937

[22] Filed: Mar. 27, 1978

[51] Int. Cl.[2] ..... A47C 4/02

[52] U.S. Cl. ..... 297/16; 297/440

[58] Field of Search ..... 297/16, 46, 47, 48, 297/441, 17, 19, 24, 25

[56] References Cited

U.S. PATENT DOCUMENTS

| | | | |
|---|---|---|---|
| 2,512,806 | 6/1950 | Neiborn | 297/16 X |
| 2,657,737 | 11/1953 | Kanaval | 297/441 X |
| 3,123,395 | 3/1964 | Glass | 297/16 |
| 3,124,387 | 3/1964 | Maclaren | 297/16 |
| 3,450,432 | 6/1969 | Minsker | 297/17 |
| 3,453,022 | 7/1969 | Lecuyer | 297/46 |
| 3,907,362 | 9/1975 | Zerlaut | 297/17 X |

*Primary Examiner*—Ramon S. Britts

*Assistant Examiner*—Peter A. Aschenbrenner

*Attorney, Agent, or Firm*—Hauke and Patalidis

[57] ABSTRACT

A foldable chair made of four separate frame members mounted hingeable around a common axis. One of the frame members is provided with a length of stretched fabric, such as canvas, and forms the seat of the chair. Another of the frame members is similarly provided with a length of stretched fabric, such as canvas, and forms the back of the chair. The other frame members form the feet of the chair. When the chair is in normal use, the four frame members are held in angular position relative to each other about their common hinging axis by means of tension cables. The chair is folded by rotating the diverse frame members around their common hinging axis to a position wherein the diverse frame members nest substantially within each other and are disposed substantially coplanar with each other.

24 Claims, 8 Drawing Figures

FIG. 1
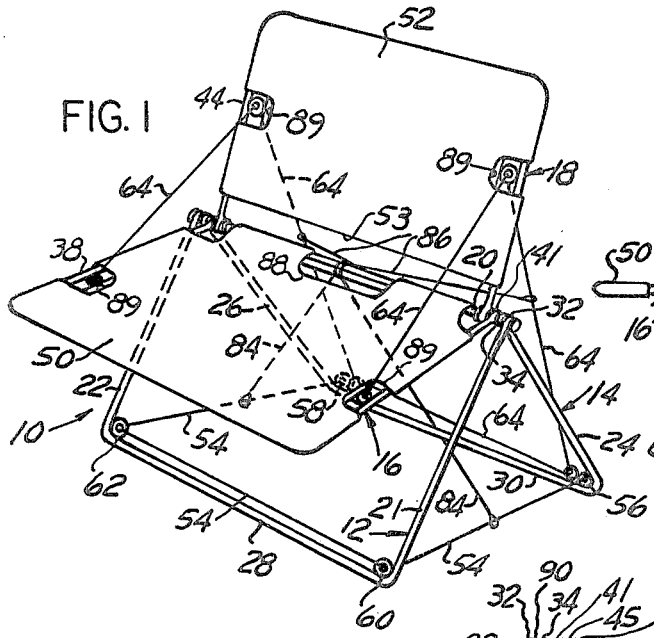
FIG. 2
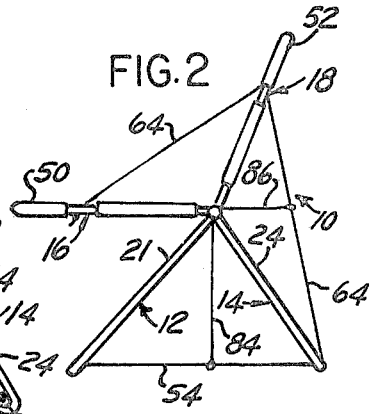
FIG. 3
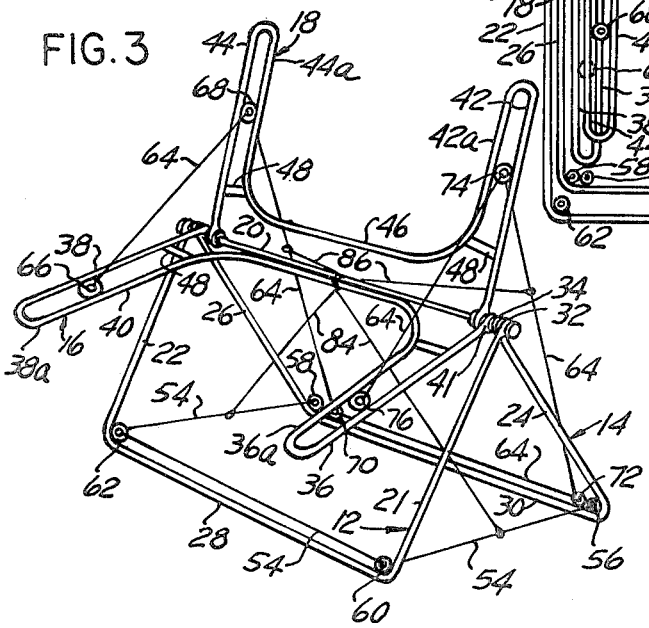
FIG. 4
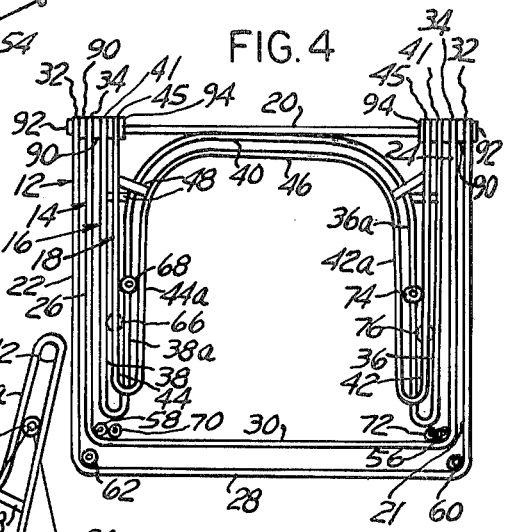
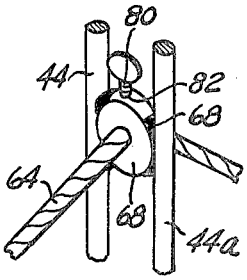
FIG. 5

FOLDABLE CHAIR

BACKGROUND OF THE INVENTION

The invention relates to furniture and more particularly to body supporting foldable furniture, such as foldable chairs and the like.

A wide variety of foldable furniture, such as foldable chairs, has been designed in the past, but in many respects, such prior art structures have generally been unsound structurally for many reasons. Some foldable furniture consist of an assembly of separate elements hinged or pivoting at several diverse pivot points, thus resulting in complex structures which are difficult to fold and unfold, which do not provide stable support when unfolded, and which are not easily carried. Other foldable furniture present the disadvantage of being somewhat bulky when folded for transportation or storage. Other foldable furniture are provided with removable pins, telescopic members, retaining pins sliding in slots, and other elements which are difficult to manufacture and assemble, thus resulting in high manufacturing costs and in many inconveniences in use.

SUMMARY

The present invention provides a simple structure for foldable furniture, such as foldable chairs, consisting of four basic frame members pivotally interconnected around a common hinge axis. In the folded position of the chair, the frame members are substantially nested within each other in a common plane, and in the unfolded position, they are disposed angularly around their common hinging axis by supporting tension cables. A pair of the frame members form legs for the chair, and the other pair of frame members form the seat and back of the chair and are provided with a length of canvas stretched over the framework for supporting the body of a person.

The present invention has therefore for principal object to provide a structure for a foldable chair, which is relatively simple and low in manufacturing cost, which provides firm support when erected, which is light and easy to carry when unfolded, and which occupies a very small space when stored.

Brief Description of the Drawing

The many objects and advantages of the present invention will become apparent to those skilled in the art when the following description of an example of the best mode contemplated for practicing the invention is read in conjunction with the accompanying drawing, wherein:

FIG. 1 is a perspective view of an example of folding chair according to the present invention;

FIG. 2 is a side view thereof;

FIG. 3 is a perspective view similar to FIG. 1 but showing only the framework thereof;

FIG. 4 is a plan elevation view of the framework of FIG. 3 in its folded position;

FIG. 5 is a detailed perspective view of a portion of the chair framework; and

DETAILED DESCRIPTION OF THE PREFERRED EMBODIMENT

Figure 6:
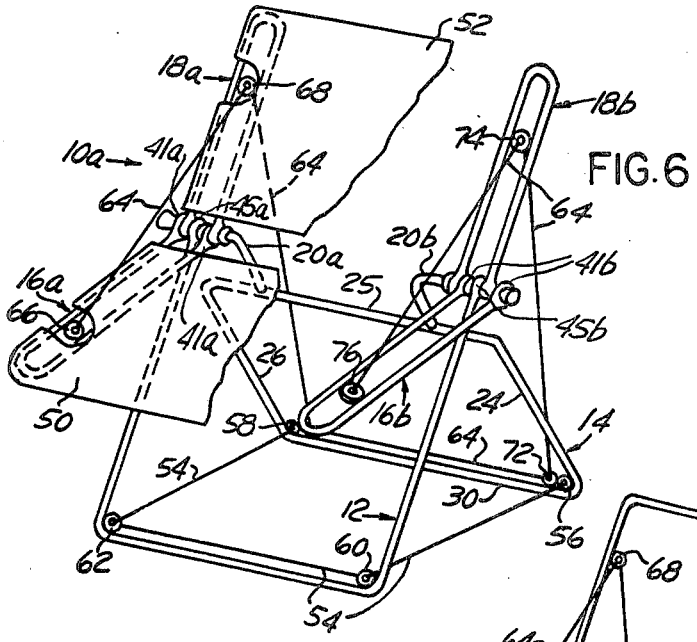
FIGS. 6–8 are views similar to FIG. 3, but showing modifications of the framework of the chair of the invention.

Referring to the drawing, and more particularly to FIGS. 1–3 thereof, a folding chair 10 comprises substantially four separate frame members 12, 14, 16 and 18 pivotally mounted on a common pivot rod 20. Each frame member 12, 14, 16 or 18 is made of a length of metallic rod or tubing, such as steel, aluminum or the like, bent to the appropriate shape illustrated. The frame members 12 and 14 each comprise a pair of substantially parallel side members 21–22 and 24–26, respectively, joined by an integral cross member 28 and 30, respectively. The free ends of the lateral members 21 and 22 of the frame member 12 are each formed as a loop 32 through which is passed the pivot rod 20. Similarly, the free ends of the lateral members 24 and 26 of the frame member 14 are provided with a loop 34 through which is passed the common pivot rod 20.

The frame member 16 has a pair of substantially parallel side members 36 and 38 integrally interconnected by means of a U-shaped portion 40 having a straight portion **36*a* substantially parallel to the side member 36 and a straight portion 38*a* substantially parallel to the side member 38. The free ends of the side members 36 and 38 of the frame member 16 are also provided each with a loop 41 through which is passed the common pivot rod 20. The frame member 18 is shaped such as to form a pair of side members 42 and 44 each having a loop 45 at its end, through which passes the pivot rod 20, the side members 42 and 44 being integrally interconnected by a U-shaped portion 46. The U-shaped portion 46 has a straight portion 42*a* extending substantially parallel to the side member 42 and a straight portion 44*a* extending substantially parallel to the side member 44. Reinforcing strut elements, as shown at 48, may be welded as shown to increase the rigidity of the frame members 16 and 18**.

The frame members 12 and 14 form the legs of the chair 10, while the frame members 16 and 18 respectively form the seat and the back of the chair. For that purpose, the frame member 16 is provided with a body supporting surface consisting of a length of canvas 50, FIG. 1 forming the seat of the chair and the frame member 18 is similarly provided with a length of canvas 52 forming the back of the chair. Each length of canvas 50 or 52 has a gusset, not shown, at each lateral edge through which is passed the lateral narrow portions of the frame member 16 and 18, respectively, formed by the substantially parallel side members **36–36*a*, 38–38*a*, 42–42*a* and 44–44*a*. The rear edge of the seat canvas 50 is preferably folded over the adjoining pivot rod 20 and the bottom portion of the U-shaped frame portion 40, and attached, by stitching for example, to the lower surface of the seat canvas. The bottom edge 53 of the back canvas 52 is disposed a short distance above the pivot rod 20** so as to clear the pivot rod.

The folding chair 10 of the invention is held in its erected position, FIGS. 1–3, by appropriate tension flexible cables, preferably steel stranded cables. A first tension cable 54 holds the chair leg-defining frame members 12 and 14 in an appropriate angular position relative to each other as a result of one end of the cable 54 being attached to a ring 56 welded or otherwise fastened within the corner formed by the side member 24 of the frame member 14 bent over at a substantially right angle for forming the cross member 30. The other end of the cable 54 is attached to a second ring 58 welded in the other corner of the frame member 14 where the cross member 30 bends into the side member 26, after being threaded through a pair of similar rings 60 and 62 each welded at corresponding corners of the frame member 12.

A second steel cable 64 is used for holding the seat frame member 16 in an appropriate angular relationship relative to the seat back frame member 18, and both the seat frame member 16 and the seat back frame member 18 in an appropriate angular relationship relative to the leg frame members 12 and 14. For that purpose, the steel cable 64 is anchored at one end to a ring 66 welded between the substantially parallel integral side members 38 and 38*a* of the seat frame member 16, is threaded through a ring 68, similarly welded between the substantially parallel integral side members 44 and 44*a* of the seat back frame member 18, is further threaded through a pair of opposite rings 70 and 72 welded proximate to the rings 58 and 56 on the rear leg frame member 14, and, from the ring 72, is threaded through a ring 74 welded between the substantially parallel side members 42 and 42*a* of the seat back frame member 18, the end of the cable 64 being anchored to a ring 76 welded between the side members 36 and 36*a* of the seat frame 16. Clamping means are provided in both rings 68 and 74 of the back frame member 18, such as to provide positive angular positioning of the back and seat portions of the chair relative to the leg portions.

The length of the tension cables 54 and 64 may be made adjustable by using a cable length greater than necessary and providing adjustable clamping means for at least one of the cable ends in one of the fastening rings, in the same manner as the cable 64 is adjustably anchored in the rings 68 and 74. An example of such adjustable anchoring means for the tension cables is illustrated in detail at FIG. 5 relative, for example, to the manner in which the cable 64 is adjustably anchored in the ring 68 by means of, for example, a set screw 80 radially threading through an appropriate threaded aperture 82, the end of the screw 80 projecting within the ring 68 abutting in clamping engagement with the periphery of the cable 64.

It will be readily apparent that the weight of a person sitting on the chair 10 is supported partly by the strong pyramidal structure provided by the leg frame members 12 and 14, and by the tension cables 64 and 54. When it is desired to fold the chair 10 for transportation or storage, the frame members 16, 18 and 14 are rotated clockwise, as seen in FIG. 2, relative to the frame member 12, such that in the carrying and storage collapsed position illustrated at FIG. 4, the frame member 14 is nested within the frame member 12, and the frame members 16 and 18, although superimposed, are nested within the frame member 14. Two pairs of elastic bands 84 and 86 have one end of each attached to the pivot rod 20 and the other end of each attached by means of a ring or clip to the cables 54 and 64, respectively, such as to pull the cables inwardly during the folding operation, for facilitating the folding operation and preventing entanglement of the cables. A cutout portion 88 is provided on the length of the canvas 50 forming the seat of the chair to provide a reach to the pivot rod 20 and the bottom of the U-shaped portion 40 and 46 of the seat and back frame members 16 and 18 for carrying the folded chair. Appropriate cut-out portions 89 are provided in the canvas seat 50 and back 52 for clearing the cable 64.

It will be readily appreciated that when the chair of the invention is folded, as illustrated at FIG. 4 which omits the canvas coverings of the seat and back portions and which also omits representing the cables 54 and 64 for the sake of simplification, the total thickness of the folded chair is that of the superimposed canvas covered frame members 16 and 18. For that purpose, the center of the loops 45 is preferably slightly eccentric relative to the plane of the back frame member 18 and the center of the loops 41 is symetrically slightly eccentric relative to the plane of the seat frame member 16. In view of the fact that all the frame members are pivotable relative to the pivot rod 20, during handcarrying of the chair, there is no possibility of the frame members unfolding. Also, as best shown at FIG. 4, the pivot fastening of the frame members 12–18 to the pivot rod 20, effected by means of the looped ends 32, 34, 41 and 45 of the frame members is very simple in structure, appropriate spacing washers 90 being disposed between consecutive looped ends to provide adequate spacing, and the whole assembly being held pivotally relative to the pivot rod 20 between each end of the rod 20, enlarged by hammering as shown at 92, and a lock washer 94.

FIG. 6 represents a modification 10*a* a of folding chair according to the present invention, constructed according to the same principle as the folding chair of FIGS. 1–5, but with a slight modification of structure. In the structure of FIG. 6, the rear leg frame 14 is in the form of a substantially rectangular closed loop comprising integral cross-member 30 and side members 24 and 26, provided with a second cross-member 25 substantially parallel to the cross-member 30. The frame member 14 is in the form preferably of a single length of steel rod or metallic tubing with the ends butt-welded, and the pivot rod 20 of the embodiments of FIGS. 1–4 is replaced by a pair of L-shaped rod members 20*a* and 20*b* disposed substantially in the same plane as the plane of the frame member 14 and welded to the upper cross-member 25 thereof, as shown.

The seat of the chair 10*a* is formed by a pair of separate U-shaped frame sections 16*a* and 16*b* which are mounted over the L-shaped rods 20*a* and 20*b*, respectively, each by means of a pair of loops 41*a* and 41*b*. The back of the chair 10*a* is similarly made of two separate U-shaped frame member sections 18*a* and 18*b* similarly mounted on the L-shaped pivot rod members 20*a* and 20*b* by way of appropriate loops 45*a* and 45*b*. The seat is formed by a piece of canvas or fabric 50 provided with appropriate gussets to accept the frame members 16*a* and 16*b*, while the back is formed by a piece 52 of canvas, or other material, with appropriate gussets accepting therethrough the back frame members 18*a* and 18*b*. It can be seen that, in the structure of FIG. 6, there is no pivot rod running the whole width of the chair at the junction between the seat and the back, thus increasing the comfort of the chair for a person sitting on it.

Figure 8:
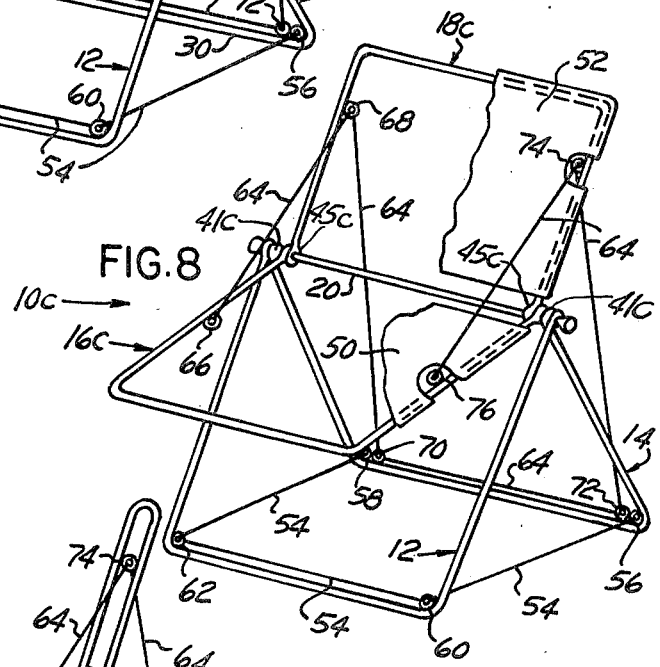
Figure 7:
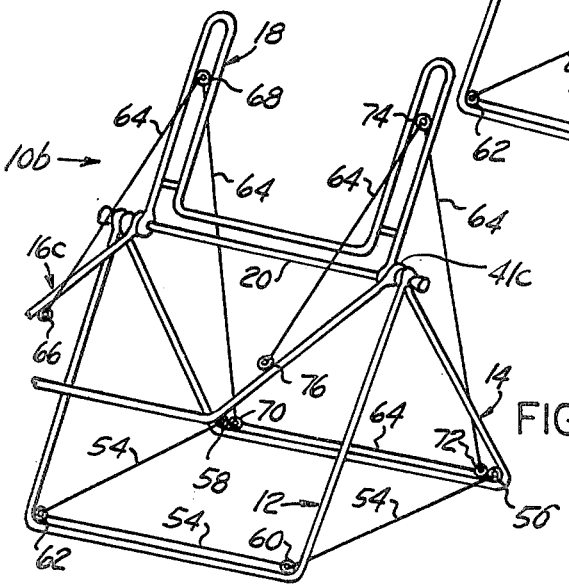

The structure of the chair 10*b* of FIG. 7 is sustantially the same as that of the chair 10 of FIGS. 1–4, with the exception that the seat of the chair consists of a simple three-sided rectangular frame member 16*c*, identical in structure to the legs frame member 12 and 14, and attached by means of looped ends 41*c* to the pivot rod 20. FIG. 8 illustrates a very simplified structure 10*c* wherein both the seat frame member 16*c* and the back frame member 18*c* are made each of a single length of steel rod or metallic tubular material, shaped exactly in the same manner as the leg frame members 12 and 14 and fastened hingedly to the pivot rod 20 by means of loops 41*c* and 45*c*, respectively.

In the structure illustrated at FIGS. 6–8, although the tension cables holding the framework in position when the respective chairs are erected have been shown, the elastic pull bands for pulling the tension cables during folding of the chair frames have not been illustrated for the sake of simplification, but it will be readily apparent that such elastic pull bands, illustrated and described relative to the embodiment of FIGS. 1–4, can also be used for the same purpose.

Having thus described the invention by way of an example of structural embodiment thereof, modifications whereof will be apparent to those skilled in the art, what is claimed as new is as follows:

1. A foldable chair comprising a pair of support leg frame members hinged together by means of a pivot rod, each of said leg frame members comprising a single length of rod formed substantially as a rectangular frame having an open side pivotably attached to said pivot rod and one of said frame members being of smaller width and length than the other such as to be disposed within the perimeter of the other when in a folded position, a seat frame member and a back frame member pivotably attached to said pivot rod and having overall dimensions smaller than the smaller of said leg frame members for nesting within the periphery of said smaller leg frame member when in a folded position, first tension cable means interconnecting said leg frame members in a relative angular position when said chair is erected, second tension cable means for interconnecting said seat frame member and said back frame member in relative angular position when said chair is erected, third tension cable means interconnecting said back frame member and the rearmost of said leg frame member when said chair is erected, biasing means urging said cable means toward said pivot rod when said chair is folded, and a body support surface disposed at least on said seat frame member.

2. The foldable chair of claim 1 wherein said body support surface is a length of fabric stretched over said seat frame member.

3. The foldable chair of claim 2 wherein said body support surface further comprises a second length of fabric stretched over said back frame member.

4. The foldable chair of claim 1 wherein said second and third cable means comprise a single length of flexible cable having both its ends attached laterally to said seat frame member and the portion of said cable intermediate said ends laced through apertures disposed in said back frame member and said rearmost leg member, and further comprising means adjustably clamping said cable relative to the back frame member.

5. The foldable chair of claim 4 wherein said cable is adjustable in length.

6. The foldable chair of claim 2 further comprising a cut-out portion in said fabric proximate said pivot rod for hand-carrying said foldable chair by said pivot rod when folded.

7. The foldable chair of claim 3 wherein said second length of fabric extends short of said pivot rod, and further comprising a cut-out portion in said first length of fabric proximate said pivot rod for hand-carrying said foldable chair by said pivot rod when folded.

8. The foldable chair of claim 1 wherein said seat frame member and said back frame member are each formed substantially as a rectangular frame having an open side pivotably attached to said pivot rod.

9. The foldable chair of claim 1 wherein said seat frame member comprises a single length of metallic rod formed as a substantially U-shaped frame having the base side of said U-shaped frame pivotally attached to said pivot rod.

10. The foldable chair of claim 1 wherein said back frame member comprises a single length of metallic rod formed as a substantially U-shaped frame having the base side of said U-shaped frame pivotally attached to said pivot rod.

11. The foldable chair of claim 1 wherein said pivot rod comprises a pair of symmetrically disposed L-shaped pivot rod members rigidly attached to one of said leg frame members, and said seat and back frame members comprise each a pair of separate substantially narrow U-shaped frame members pivotally attached to each of said L-shaped pivot rod members.

12. A foldable chair comprising a pair of support leg frame members hinged together by means of a pivot rod, each of said leg frame members comprising a single length of rod formed substantially as a rectangular frame having an open side pivotably attached to said pivot rod and one of said frame members being of smaller width and length than the other such as to be disposed within the perimeter of the other when in a folded position, a seat frame member and a back frame member pivotably attached to said pivot rod and having overall dimensions smaller than the smaller of said leg frame members for nesting within the periphery of said smaller leg frame member when in a folded position, first tension cable means interconnecting said leg frame member in a relative angular position when said chair is erected, second tension cable means for interconnecting said seat frame member and said back frame member in relative angular position when said chair is erected, third tension cable means interconnecting said back frame member and the rearmost of said leg frame member when said chair is erected, and a body support surface is disposed at least on said seat frame member, wherein said first tension cable means comprises a single length of flexible cable having both its ends attached to one of said leg frame members at two different extreme locations, said cable being passed between its ends through each of apertures dependent from said other leg frame member.

13. The foldable chair of claim 12 wherein said body support surface is a length of fabric stretched over said seat frame member.

14. The foldable chair of claim 13 wherein said body support surface further comprises a second length of fabric stretched over said back frame member.

15. The foldable chair of claim 12 wherein said second and third cable means comprises a single length of flexible cable having both its ends attached laterally to said seat frame member and the portion of said cable intermediate said ends laced through apertures disposed in said back frame member and said rearmost leg member, and further comprising means adjustably clamping said cable relative to the back frame member.

16. The folding chair of claim 12 further comprising biasing means urging said cable means toward said pivot rod when said chair is folded.

17. The foldable chair of claim 12 wherein said cable is adjustable in length.

18. The foldable chair of claim 15 wherein said cables are adjustable in length.

19. The foldable chair of claim 13 further comprising a cut-out portion in said fabric proximate said pivot rod for hand-carrying said foldable chair by said pivot rod when folded.

20. The foldable chair of claim 14 wherein said second length of fabric extends short of said pivot rod, and further comprising a cut-out portion in said first length of fabric proximate said pivot rod for hand-carrying said foldable chair by said pivot rod when folded.

21. The foldable chair of claim 12 wherein said seat frame member and said back frame member are each formed substantially as a rectangular frame having an open side pivotably attached to said pivot rod.

22. The foldable chair of claim 12 wherein said seat frame member comprises a single length of metallic rod formed as a substantially U-shaped frame having the base side of said U-shaped frame pivotally attached to said pivot rod.

23. The foldable chair of claim 12 wherein said back frame member comprises a single length of metallic rod formed as a substantially U-shaped frame having the base side of said U-shaped frame pivotally attached to said pivot rod.

24. The foldable chair of claim 12 wherein said pivot rod comprises a pair of symmetrically disposed L-shaped pivot rod members rigidly attached to one of said leg frame members, and said seat and back frame members comprise each a pair of separate substantially narrow U-shaped frame members pivotally attached to each of said L-shaped pivot rod members.

* * * * *